US005785406A

United States Patent [19]

Lee

[11] Patent Number: 5,785,406

[45] Date of Patent: Jul. 28, 1998

[54] STRAW WITH SOUND/LIGHTING EFFECT PRODUCING MEANS

[76] Inventor: Jen-Wang Lee, 7Fl., No.768, Chung Cheng Rd., Chung Ho, Taipei Hsien, Taiwan

[21] Appl. No.: 895,026

[22] Filed: Jul. 16, 1997

[51] Int. Cl.[6] ..... F21V 33/00

[52] U.S. Cl. ..... 362/96; 362/253; 362/800; 362/806

[58] Field of Search ..... 362/961, 101, 362/800, 806, 86, 253

[56] References Cited

U.S. PATENT DOCUMENTS 4,901,922 2/1990 Kessener et al. ..... 362/96 X 5,333,639 8/1994 Nelson ..... 362/96 X 5,575,553 11/1996 Tipton ..... 362/101

*Primary Examiner*—Stephen F. Husar

*Attorney, Agent, or Firm*—Bacon & Thomas

[57] ABSTRACT

A straw including a straw body; a container fixedly mounted around the straw body; a sound and lighting effect generating control circuit board mounted within the container; and a sensor pad mounted between the straw body and the container to detect the presence of a liquid passing through the straw body and to provide a signal to the control circuit board upon the detection of the presence of a liquid passing through the straw body causing the control circuit board to provide sound and lighting effects.

6 Claims, 4 Drawing Sheets

STRAW WITH SOUND/LIGHTING EFFECT PRODUCING MEANS

BACKGROUND OF THE INVENTION

The present invention relates to straws for use in taking up a drinking from a cup, and more specifically the invention relates to a straw which produces sound and lighting effects when a liquid is sucked in.

A variety of straws have been disclosed for use in taking up a drinking from a cup. These straws may be decorated with decoration means or made bendable in order to attract the consumers. However, these conventional designs are still monotonous because they cannot produce any sound or lighting effect when in use.

SUMMARY OF THE INVENTION

The present invention has been accomplished to provide a straw which produces sound and lighting effects when a liquid is sucked in. According to one aspect of the present invention, the straw comprises a straw body, a container fixedly mounted around the straw body, and a control circuit board mounted in the container which is triggered to produce sound and lighting effects when a liquid is sucked in the straw body. According to another aspect of the present invention, the control circuit board can produce a sound effect simulating the sound of an insect or a bird, and a lighting effect showing any of a variety of patterns. According to still another aspect of the present invention, the control circuit board comprises a speed generator which controls a light emitting diode to produce light in matching with the speed of the sound effect.

DETAILED DESCRIPTION OF THE PREFERRED EMBODIMENT

Figure 1:
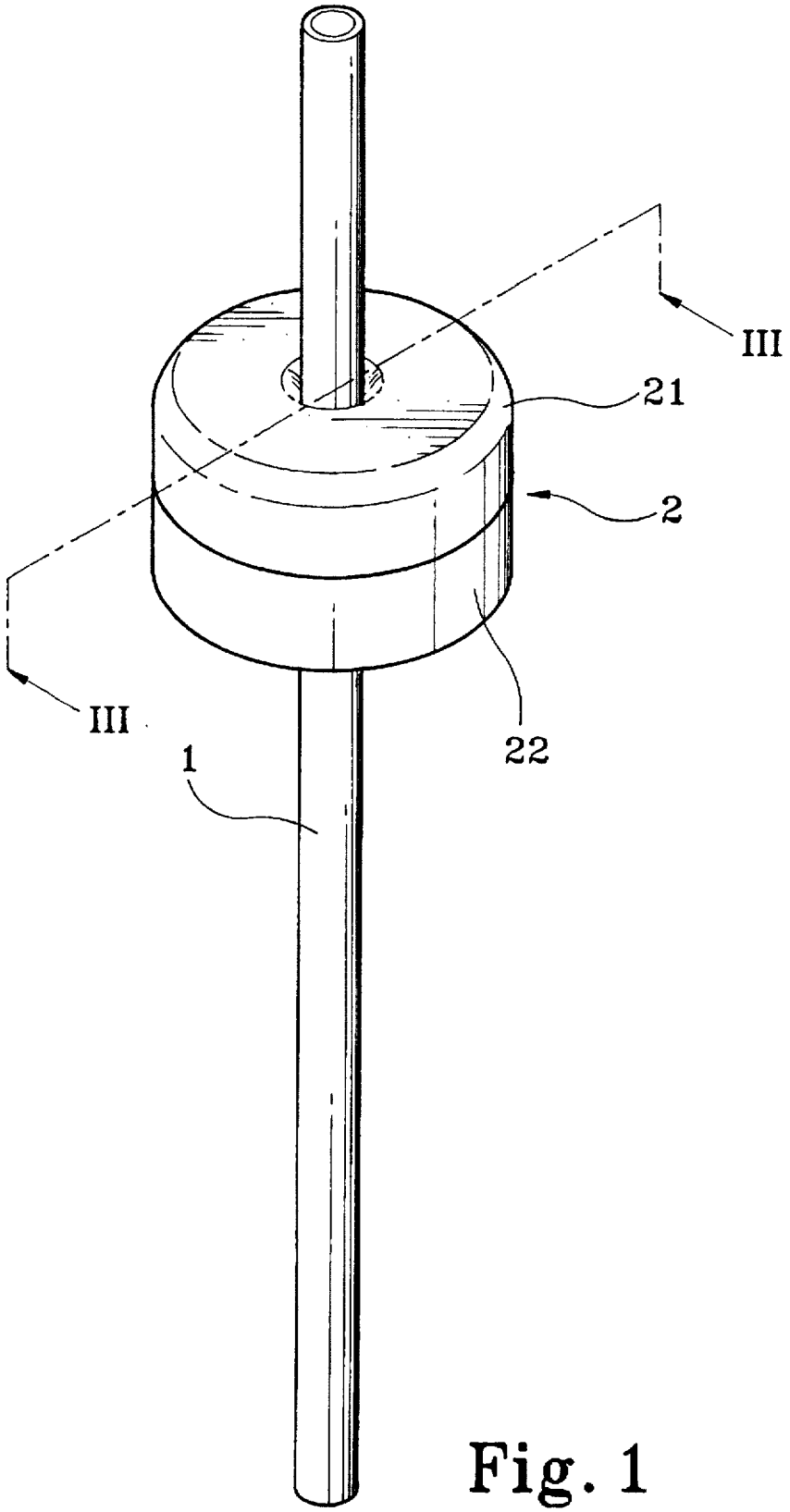
FIG. 1 is an elevational view of a straw according to the present invention.
Figure 2:
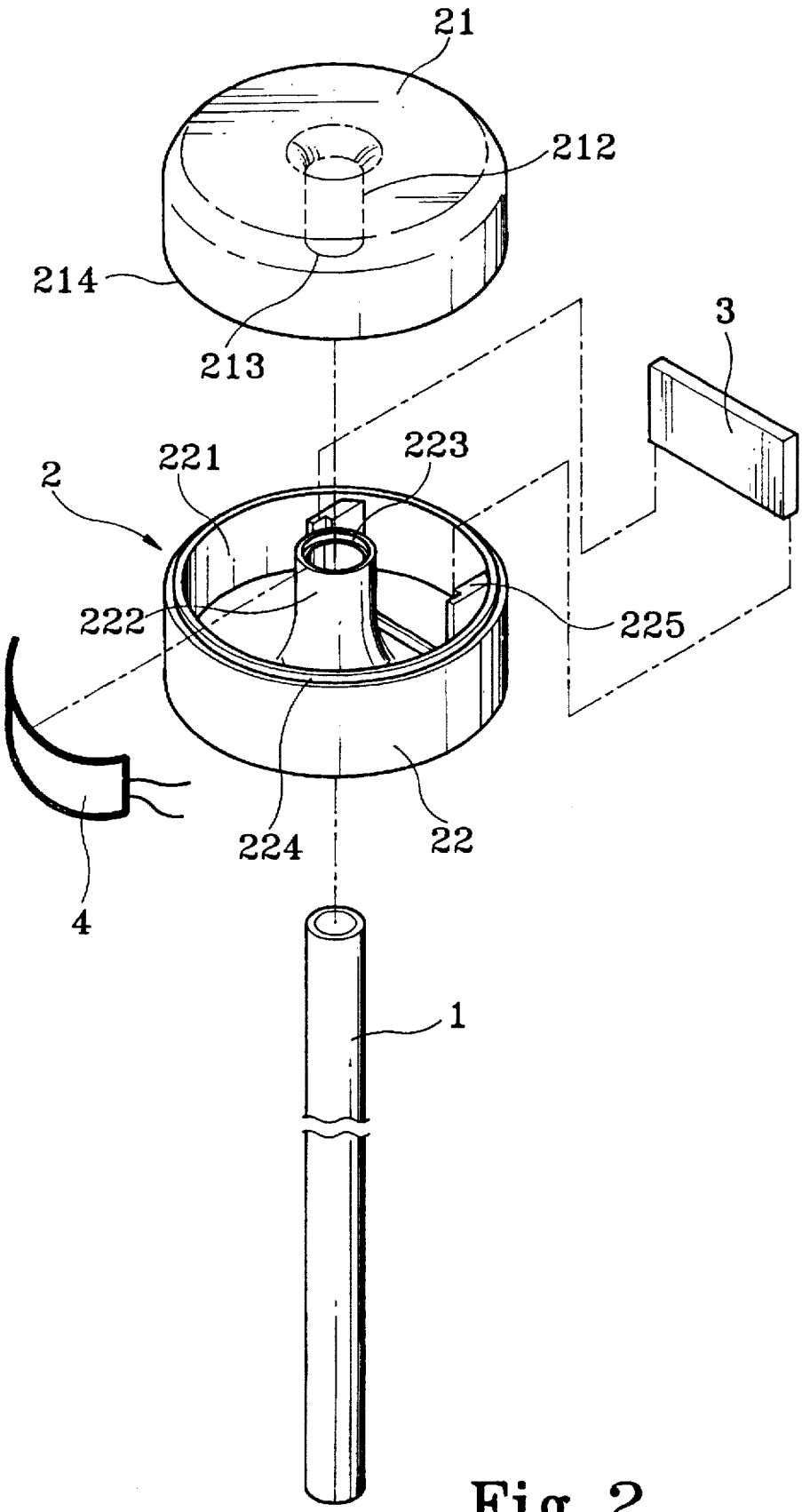
FIG. 2 is an exploded view of the straw shown in FIG. 1.
Figure 3:
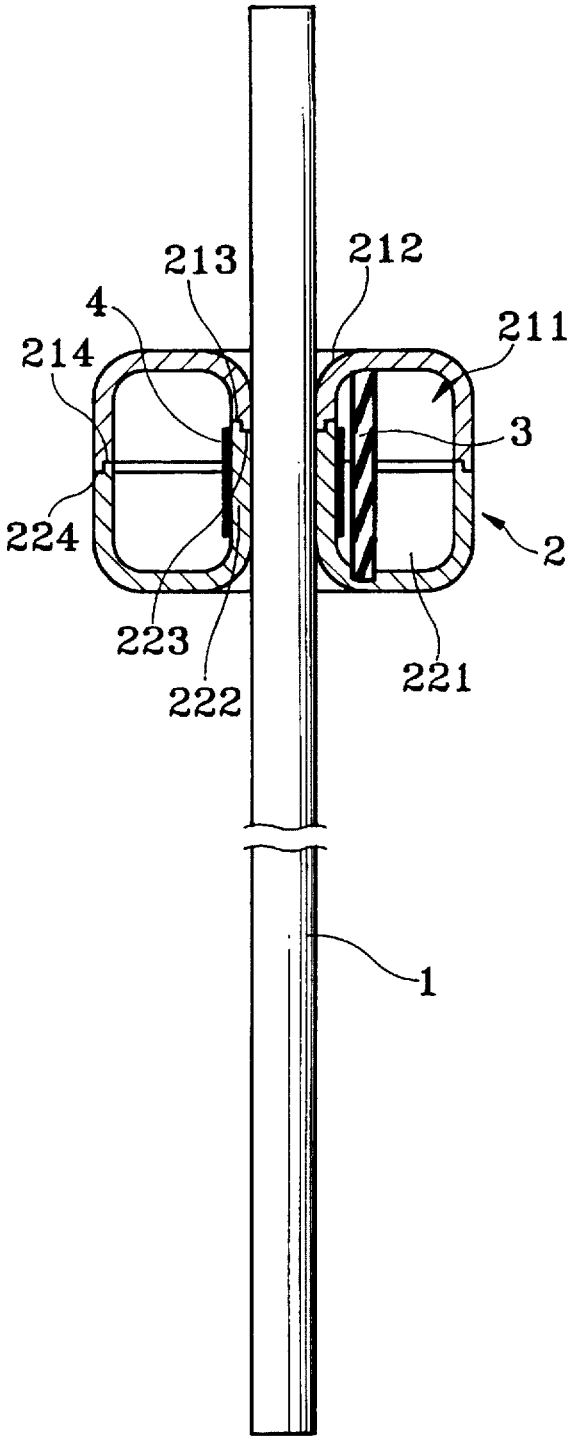
FIG. 3 is a sectional view taken along line III—III of FIG. 1.

Referring to FIGS. 1, 2 and 3, a straw in accordance with the present invention is generally comprised of a straw body 1 molded from glass or plastic, a container 2 mounted around the straw body 1, a control circuit board 3 and a sensor pad 4 respectively mounted in the container 2. The container 2 is mounted around the straw body 1, comprised of a bottom shell 22 and an upper shell 21 covered on the bottom shell 22. The bottom shell 22 comprises an upward center tube 222 adapted to receive the straw body 1, a top open chamber 221 around the center tube 222, a locating frame 225 disposed inside the top open chamber 221, a first coupling portion 223 within the upward center tube 222 at its top, and a second coupling portion 224 around the periphery at its top. The upper shell 21 comprises a downward center tube 212 adapted to receive the straw body 1, a bottom open chamber 211, a first coupling portion 213 disposed within the downward center tube 212 at its bottom and adapted to engage the first coupling portion 223 of the bottom shell 22, and a second coupling portion 214 disposed around the periphery at its bottom and adapted to engage the second coupling portion 224 of the bottom shell 22. The control circuit board 3 is mounted on the locating frame 225 within the top open chamber 221 of the bottom shell 22. The sensor pad 4 is made of an aluminum foil or equivalent material mounted on the inside wall of the upward center tube 222 of the bottom shell 22 and the inside wall of the downward center tube 212 of the upper shell 21, and connected to the signal input terminal of the control circuit board 3 by conductors.

Figure 4:
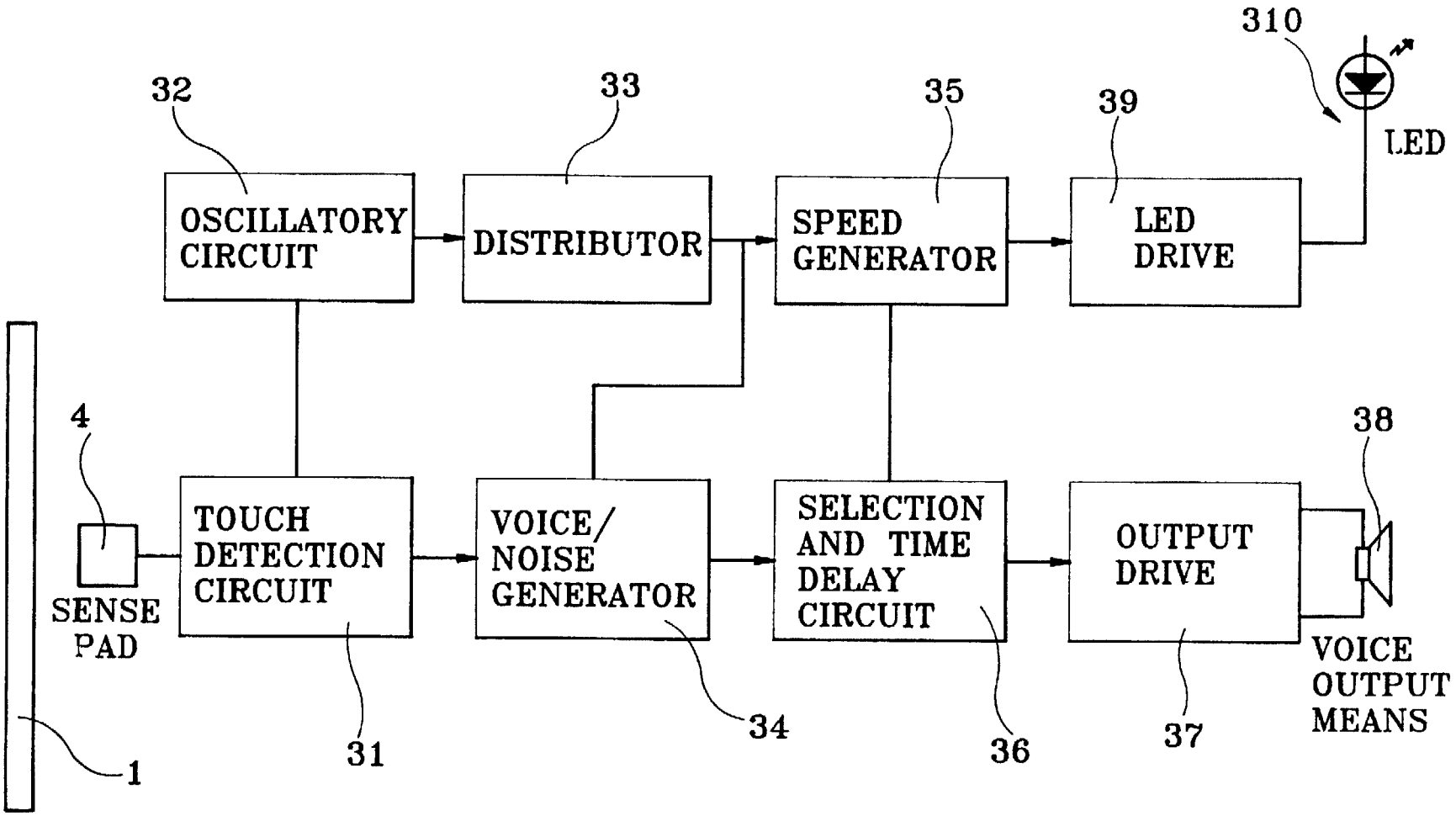
FIG. 4 is a circuit diagram of the control circuit board according to the present invention.

Referring to FIGS. 3 and 4, the control circuit board 3 comprises a touch detection circuit 31, an oscillatory circuit 32, a distributor 33, a voice/noise generator 34, a speed generator 35, a selection and time delay circuit 36, an output drive 37, voice output means 38, a LED drive 39, and a LED (light emitting diode) 310. The touch detection circuit 31 is connected to the sensor pad 4. The oscillatory circuit 32 provides a constant frequency to the sensor pad 4 through the touch detection circuit 31. When a liquid passes through the straw body 1, the amount of the surrounding static electricity around the sensor pad 4 is changed, causing the oscillation frequency of the oscillatory circuit 32 to be changed. The changed oscillation frequency is sent to the distributor 33, then transmitted from the distributor 33 to the speed generator 35 and the voice/noise generator 34 simultaneously or in proper order, and then transmitted from the voice/noise generator 34 to the output drive 37 through the selection and time delay circuit 36 causing it to drive the voice output means 38 in producing a sound effect, or transmitted from the speed generator 35 to the LED drive 39 causing it to drive the LED 310 in producing a lightening effect.

I claim:

1. A straw comprising:

a straw body;

a container fixedly mounted around said straw body;

a sound and lighting effect generating control circuit board mounted within said container; and a sensor pad mounted between said straw body and said container to detect the presence of a liquid passing through said straw body and to provide a signal to said control circuit board upon the detection of the presence of a liquid passing through said straw body causing said control circuit board to provide sound and lighting effects.

2. The straw of claim 1, wherein said straw body is molded from glass.

3. The straw of claim 1, wherein said straw body is molded from plastic.

4. The straw of claim 1, wherein said container comprises a bottom shell and an upper shell covered on said bottom shell, said bottom shell comprising an upward center tube adapted to receive said straw, a top open chamber around said upward center tube, a locating frame disposed inside said top open chamber and adapted to hold said control circuit board, and coupling means, said upper shell comprising a downward center tube adapted to receive said straw body and connected to the upward center tube of said bottom shell, a bottom open chamber matched with the top open chamber of said bottom shell, and coupling means respectively fastened to the coupling means of said bottom shell.

5. The straw of claim 1, wherein said sensor pad is made of an aluminum foil.

6. The straw of claim 1, wherein said control circuit board comprises a touch detection circuit connected to said sensor pad, an oscillatory circuit, a distributor, a voice/noise generator, a speed generator, a selection and time delay circuit, an output drive, voice output means, a LED drive, and a LED (light emitting diode), said oscillatory circuit providing a constant frequency to said sensor pad through said touch detection circuit, said oscillatory circuit being driven by said touch detection circuit to change its oscillation frequency when said touch detection circuit detects the presence of a liquid in said straw body through said sensor pad, the changed oscillation frequency being sent to said distributor, then transmitted from said distributor to said speed generator and said voice/noise generator, and then transmitted from said voice/noise generator to said output drive through said selection and time delay circuit causing it to drive said voice output means in producing a sound effect, and simultaneously transmitted from said speed generator to said LED drive causing it to drive said LED in producing a lightening effect.

* * * * *